US006467098B1

(12) United States Patent
Lee

(10) Patent No.: US 6,467,098 B1
(45) Date of Patent: Oct. 22, 2002

(54) GOGGLES WITH REMOVABLE LENSES

(75) Inventor: Tony Lee, Taipei Hsien (TW)

(73) Assignee: First Rank Co., LTD, Taipei Hsien (TW)

( * ) Notice: Subject to any disclaimer, the term of this patent is extended or adjusted under 35 U.S.C. 154(b) by 0 days.

(21) Appl. No.: 09/835,557

(22) Filed: Apr. 17, 2001

(51) Int. Cl.[7] ..... A61F 9/02
(52) U.S. Cl. ..... 2/443; 2/439
(58) Field of Search ..... 2/443, 441, 439, 2/440, 430, 428; 351/43, 90, 92

(56) References Cited

U.S. PATENT DOCUMENTS 2,182,104 A * 12/1939 Wilen et al. ..... 2/440
2,321,159 A * 6/1943 Ryan ..... 2/441
2,427,918 A * 9/1947 Malcom et al. ..... 2/441
2,914,770 A * 12/1959 Sterne et al. ..... 2/440
3,010,108 A * 11/1961 Sachs ..... 2/430
5,216,759 A * 6/1993 Hewitt et al. ..... 2/430
5,802,621 A * 9/1998 Chou ..... 2/430
5,896,589 A * 4/1999 Chou ..... 2/428
6,098,206 A * 8/2000 Chou ..... 2/428

* cited by examiner

*Primary Examiner*—Rodney M. Lindsey
(74) *Attorney, Agent, or Firm*—Birch, Stewart, Kolasch & Birch, LLP

(57) ABSTRACT

A goggles with removable lenses comprising a pair of soft lens rim each with a lens, a cushion in sucker format is formed with the soft lens rim into one body. The lens is flat with thickness less than 5 mm, on the circumference of the lens has a fixing ring in stair shape for holding, a fixing mechanism is on the fixing ring near bridge. Two soft lens rims are tied together with a bridge, the soft lens rims and the bridge are formed into one body with soft plastic. A groove in stair shape for the fixing ring and a hole for the fixing mechanism are inside the soft lens rim for a lens.

6 Claims, 6 Drawing Sheets

GOGGLES WITH REMOVABLE LENSES

BACKGROUND OF THE INVENTION

I. Field of the Invention

This invention relates generally to goggles with removable lenses and, more specifically, goggles with removable lenses that users can change the lenses with different applications: scratched or blurred lenses, color lenses, convex or concave lenses, it also provides better waterproof capability.

II. Description of the Prior Art

Heretofore, it is known that swimmers generally wear goggles to open their eyes underwater in order to see clearer and avoid damage to their eyes by foreign objects.

However a prior art as shown on FIG. 4 is constructed of a pair of soft lens rim a each with a lens b that is made of hard material, the lens b is fixed on the soft lens rim by another rim c. Since the soft lens rim a is made of soft plastic, the lens b is made of hard material and is fixed on the soft lens rim a by a rim c clamping on the soft lens rim a. Therefore after a period of time, the soft lens rim a might be distorted by pressure and cause gap generated between the soft lens rim a and the lens b. Water will infiltrate in, the goggles become useless.

Referring to FIG. 5, the lenses of another known prior art are in curve instead of flat. The curved lens d has a fixing rim d1 on its circumference, the soft lens rim a has a corresponding groove a1, the curved lens d can be fixed on the soft lens rim a by the placing fixing rim d1 on groove a1. Even though the lens shape is changed from flat to curve, the whole structure remain the same, the infiltration might still occur.

Referring to FIG. 6, a plant-in goggles structure; the flat lens e of the known prior art has a plurality number of hole e1, the lens e is in the soft lens rim a while the soft lens rim a is formed. The lens e can be fixed on the soft lens rim a, however it is not removable once scratched or blurred.

Usually, the lenses of goggles get scratches or become easily blurred, therefore it is desirable for users to change the damaged lenses to new one or to have color or sight correction lenses, to lengthen the life of the goggles.

SUMMARY OF THE INVENTION

It is therefore a primary object of the invention to provide goggles with removable lenses that users can change the lenses with different applications: color lenses, convex and concave lenses, it also provides better waterproof capability.

In order to achieve the objective set forth, goggles with removable lenses in accordance with the present invention comprises a pair of soft lens rims each with a lens, a cushion in sucker format is formed with the soft lens rim into one body. The lens is flat with a thickness less than 5 mm. The circumference of the lens has a fixing ring in stair shape for holding a fixing mechanism on the fixing ring near a bridge. Two soft lens rims are tied together with a bridge; the soft lens rims and the bridge are formed into one body with soft plastic. A groove in stair shape for the fixing ring and a hole for the fixing mechanism are inside the soft lens rim for the lens.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
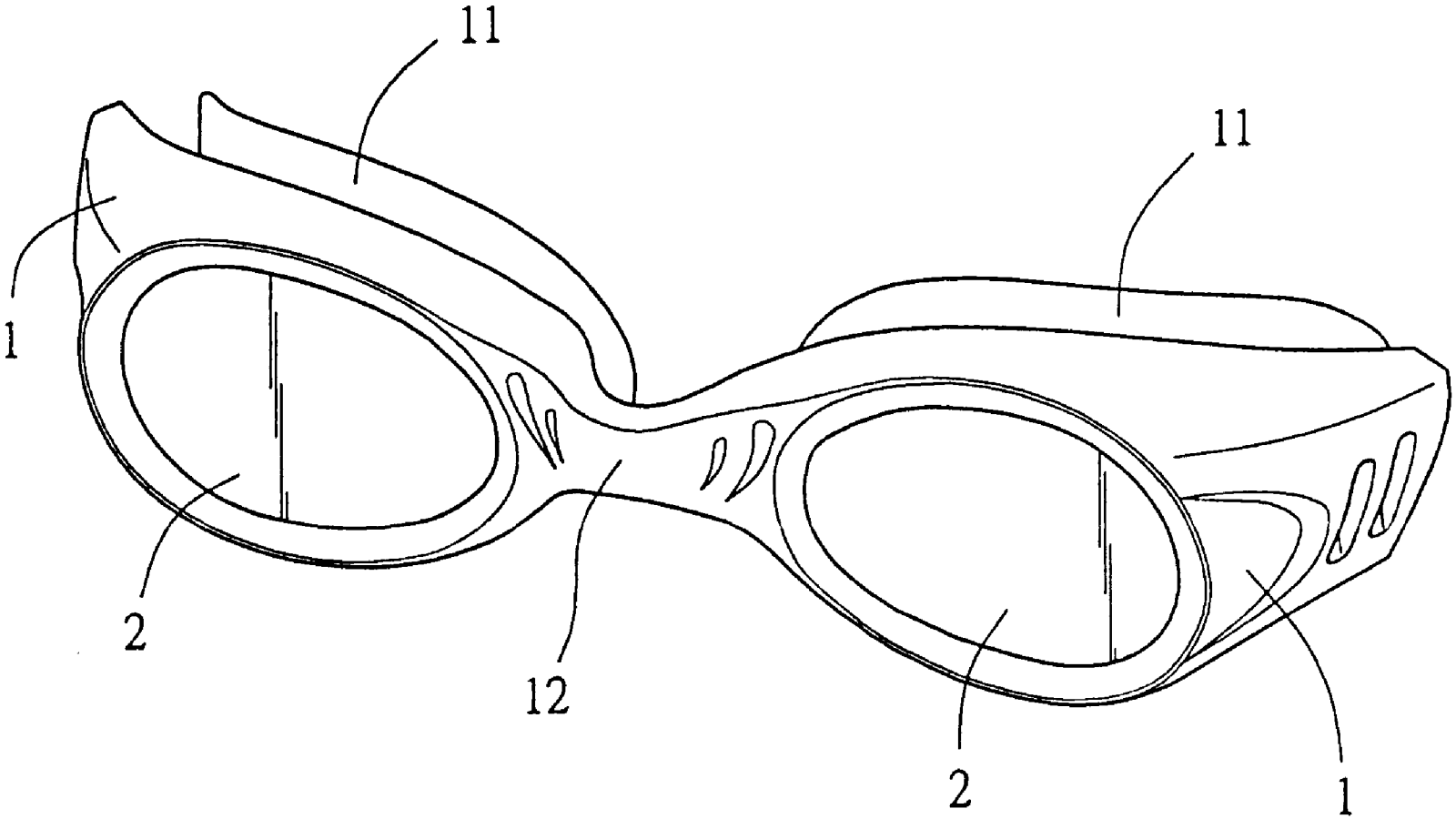
FIG. 1 is a perspective view of the present invention.

Referring to FIG. 1, the present invention is composed of a pair of soft lens rims 1 each with a lens 2, a cushion 11 in sucker format is formed with the soft rim into one body. The lens 2 is flat with a thickness less than 5 mm. On the circumference of the lens 2, a stair shaped fixing ring 21 is provided. A fixing mechanism 22 is on the fixing ring 21 near the bridge.

Figure 2:
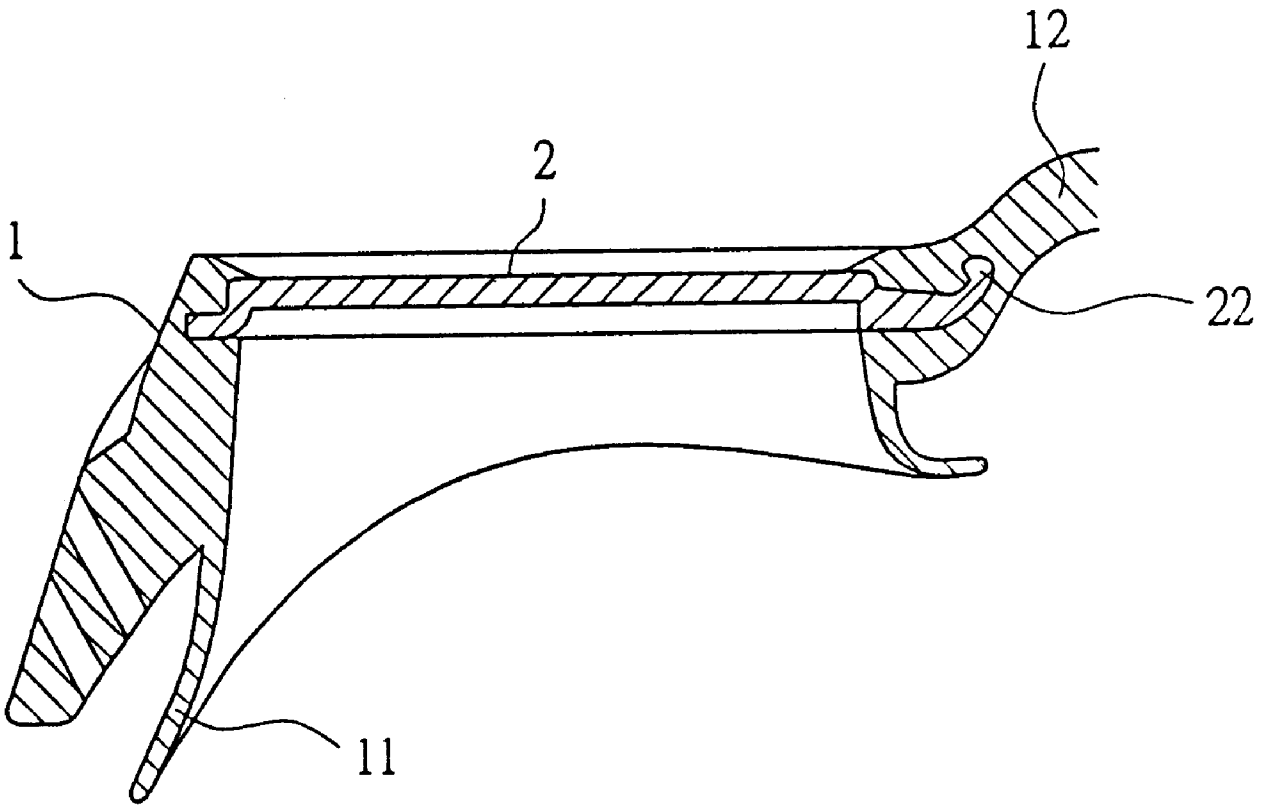
FIG. 2 is a side view, partially in section, of the present invention.
Figure 3:
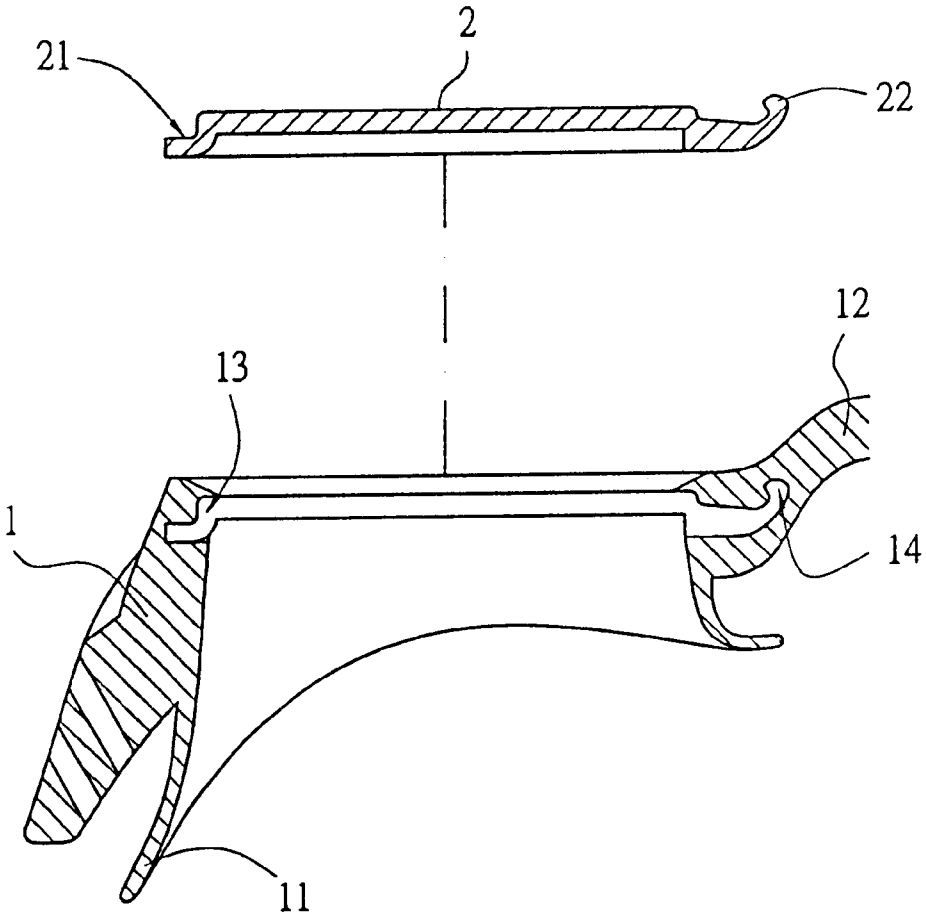
FIG. 3 is an explosive view, partially in section, of the present invention.
Figure 4:
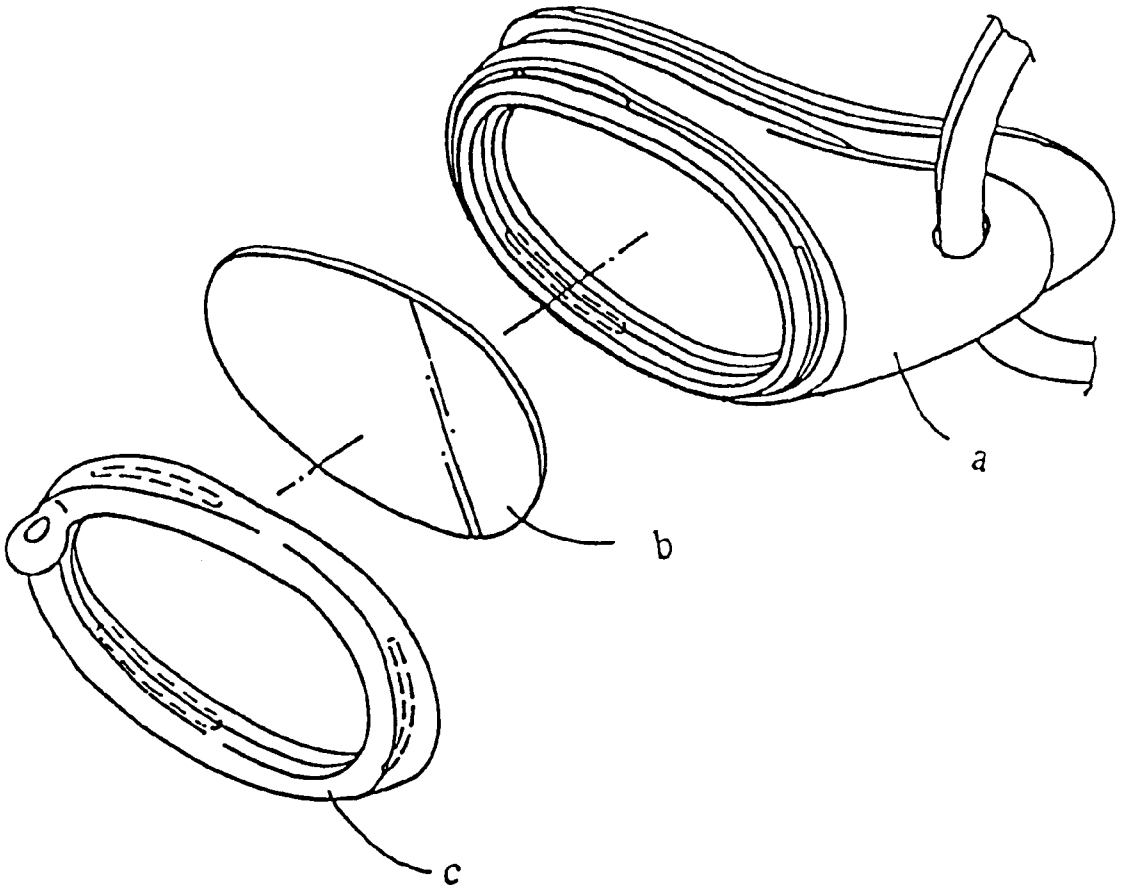
Fig.4 (Prior Art)
FIG. 4 is a partially explosive view of the present invention.
Figure 5:
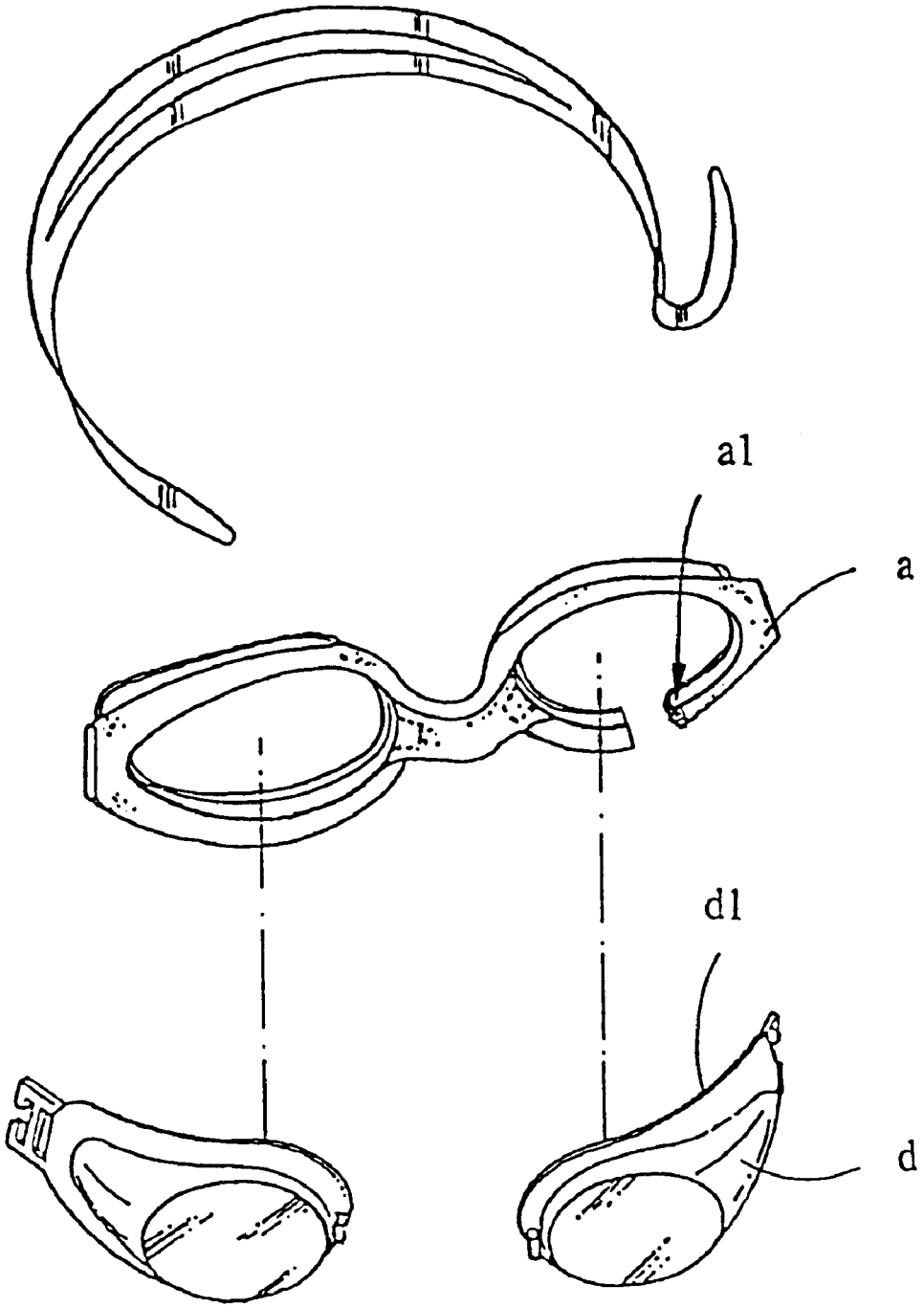
Fig.5 (Prior Art)
FIG. 5 is a partially explosive view of another prior art.
Figure 6:
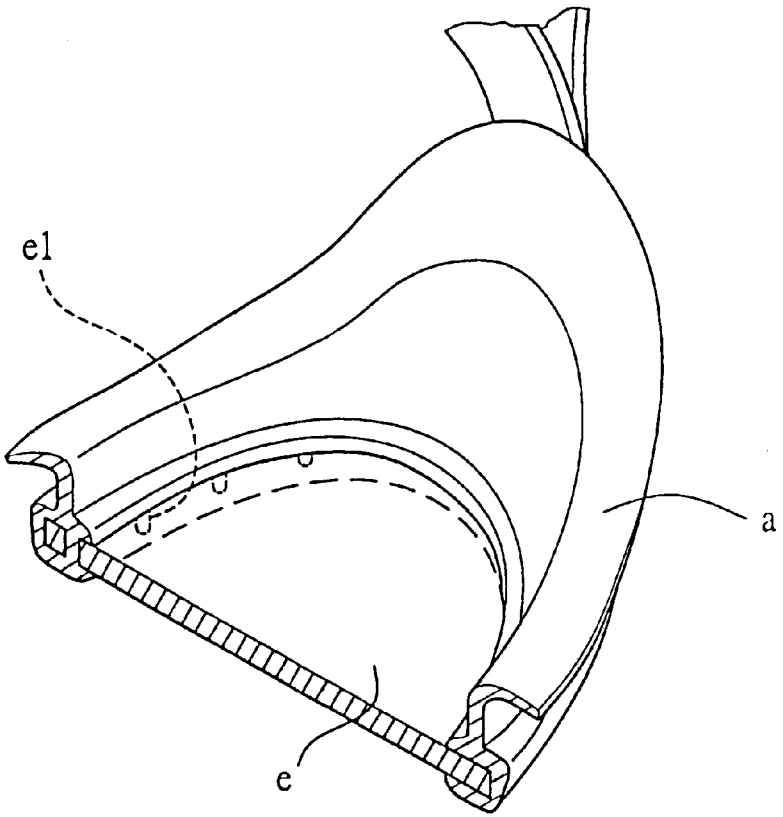
Fig.6 (Prior Art)
FIG. 6 is a side view, partially in section, of another prior art.

Two soft lens rim 1 are tied together with a bridge 12, the soft lens rim 1 and bridge 12 are formed into one body with soft plastic. Referring to FIG. 2 and FIG. 3, a groove 13 in stair shape for the fixing ring 21 and a hole 14 for the fixing mechanism 22 are inside the soft lens rim 1 for a lens 2.

Based on the above description, the soft lens rim 1 has a groove 13 and the lens 2 has a fixing ring 21. The lens 2 can be fixed firmly into the groove 13 of the soft rim 1 for better waterproof effect. The lens 2 is further fixed into the hole 14 inside the soft lens rim 1 through the fixing mechanism 22.

The lens 2 is firmly attached on the soft lens rim 1 for better waterproof effect, therefore users can replace the scratched or blurred lens 2 with a good, color or sight-correction lens, better for environment and longer goggles life. While a preferred embodiment of the invention has been shown and described in detail, it will be readily understood and appreciated that numerous omissions, changes and additions may be made without departing from the spirit and scope of the invention.

What is claimed is:

1. Goggles with removable lenses comprising:

a pair of soft lens rims, each with a lens, being connected with a bridge, said lens being flat with a thickness less than 5 mm;

a cushion in sucker format being formed with said soft rim into one body;

a stair shape fixing ring arranged on the circumference of said lens and extending in a plane parallel to a plane including the lens;

a fixing mechanism on said fixing ring near said bridge;

a groove in stair shape for said fixing ring around an inner circumference of said soft lens rim;

a hole near the bridge for said fixing mechanism located inside said soft lens rim.

2. The goggles as recited in claim 1, further comprising attachments on said soft rims for receiving a strap for securing the goggles to a head of a user.

3. The goggles as recited in claim 1, wherein the fixing mechanism is attached to and extends from the fixing ring in the plane of the Fixing Ring.

4. The goggles as recited in claim 3, wherein the fixing mechanism has a J-shape.

5. The goggles as recited in claim 1, wherein the fixing mechanism is attached to a side of the fixing ring.

6. The goggles as recited in claim 1, further comprising attachments on said soft rims for receiving a strap for securing the goggles to a head of a user, the fixing mechanism is attached to and extends from a side of the fixing ring in the plane of the Fixing Ring, the fixing mechanism having a J-shape.

* * * * *